US011448079B2

(12) United States Patent
Tate et al.

(10) Patent No.: US 11,448,079 B2
(45) Date of Patent: Sep. 20, 2022

(54) GAS TURBINE NOZZLE

(71) Applicant: Mitsubishi Heavy Industries, Ltd., Tokyo (JP)

(72) Inventors: Hiroyuki Tate, Yokohama (JP); Hironori Tsukidate, Yokohama (JP); Kunihiro Oga, Yokohama (JP); Yasuhiro Horiuchi, Yokohama (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 17/365,410

(22) Filed: Jul. 1, 2021

(65) Prior Publication Data

US 2022/0042420 A1 Feb. 10, 2022

(30) Foreign Application Priority Data

Aug. 6, 2020 (JP) ..... JP2020-133453

(51) Int. Cl.
*F01D 9/04* (2006.01)

(52) U.S. Cl.
CPC ..... *F01D 9/041* (2013.01); *F05D 2220/32* (2013.01); *F05D 2240/128* (2013.01)

(58) Field of Classification Search
CPC . F01D 9/041; F05D 2220/32; F05D 2240/128
See application file for complete search history.

(56) References Cited

U.S. PATENT DOCUMENTS 6,494,677 B1 * 12/2002 Grady ..... F01D 9/04 29/889.7
6,951,447 B2 * 10/2005 Cherolis ..... F01D 5/147 416/193 A (Continued)

FOREIGN PATENT DOCUMENTS

FR 2 894 282 A1 6/2007
JP 2007-154889 A 6/2007

(Continued)

OTHER PUBLICATIONS

Russian-language Office Action, including Search Report issued in Russian Application No. 2021123444/12(049039) dated May 5, 2022 with English translation (14 pages).

*Primary Examiner* — Igor Kershteyn
*Assistant Examiner* — Brian Christopher Delrue
(74) *Attorney, Agent, or Firm* — Crowell & Moring LLP

(57) ABSTRACT

The present invention provides a gas turbine nozzle capable of reducing stress related to thermal elongation caused by a rise in gas turbine nozzle temperature and thus reducing stress produced when thermal deformation occurs in the gas turbine nozzle. The gas turbine nozzle according to the present invention includes nozzles formed integrally through an inner perimeter end wall and an outer perimeter end wall. The inner perimeter end wall has an upstream connection portion and a downstream connection portion. The upstream connection portion extends radially inward to be connected to an inner perimeter diaphragm. The downstream connection portion is located downstream from the upstream connection portion and extends radially inward to be connected to the inner perimeter diaphragm. The inner perimeter end wall has a thin-walled portion in a rear edge portion of the inner perimeter end wall, the thin-walled portion corresponding to a reduced wall thickness portion of the rear edge portion of the inner perimeter end wall.

4 Claims, 4 Drawing Sheets

(56) References Cited

U.S. PATENT DOCUMENTS

| | | | | |
|---|---|---|---|---|
| 7,195,454 | B2 * | 3/2007 | Lu | F01D 11/005 415/181 |
| 2007/0122275 | A1 * | 5/2007 | Busch | F01D 9/042 415/209.3 |
| 2007/0128020 | A1 | 6/2007 | Dervaux et al. | |
| 2007/0154305 | A1 * | 7/2007 | Arness | F01D 9/041 415/209.2 |
| 2013/0287563 | A1 * | 10/2013 | Brummitt-Brown | F01D 9/042 415/209.4 |
| 2016/0237914 | A1 * | 8/2016 | Schwarz | F02C 7/36 |
| 2017/0211421 | A1 * | 7/2017 | Takamura | F01D 25/243 |
| 2019/0010815 | A1 | 1/2019 | Watanabe | |

FOREIGN PATENT DOCUMENTS

| | | |
|---|---|---|
| RU | 2 708 931 C1 | 12/2019 |
| SU | 1 302 780 A1 | 3/1996 |

* cited by examiner

GAS TURBINE NOZZLE

CLAIM OF PRIORITY

The present application claims priority from Japanese Patent application serial no. 2020-133453, filed on Aug. 6, 2020, the content of which is hereby incorporated by reference into this application.

BACKGROUND OF THE INVENTION

The present invention relates to a gas turbine nozzle and, more specifically, to a gas turbine nozzle of coupled vane structure in which two nozzles are formed integrally through an inner perimeter end wall and an outer perimeter end wall.

Conventional techniques in such technological field are described in, for example, Japanese Unexamined Patent Application Publication No. 2007-154889.

Japanese Unexamined Patent Application Publication No. 2007-154889 discloses a gas turbine nozzle of coupled vane structure (see FIG. 2), and describes that an inner band includes a rear flange extending radially inwardly from the inner band, that the rear flange extends radially inwardly from the inner band with respect to a radially inner surface of the inner band, that the inner band also includes a forward flange that extends radially inwardly from the inner band, and that the forward flange is positioned between an upstream edge of the inner band and the rear flange, and extends radially inwardly from the inner band with respect to the radially inner surface of the inner band (see paragraph 0009).

Japanese Unexamined Patent Application Publication No. 2007-154889 discloses the gas turbine nozzle of coupled vane structure.

In future gas turbine nozzles, as the gas turbine nozzle temperature increasingly rises during operation of the gas turbine, the gas turbine nozzle will be subjected to increased stress related to thermal elongation caused by the rise in gas turbine nozzle temperature.

Then, when thermal deformation occurs in the gas turbine nozzle, the stress occurring in the gas turbine nozzle is increased, which in turn may possibly cause a crack to appear in the gas turbine nozzle.

However, Japanese Unexamined Patent Application Publication No. 2007-154889 provides no description of gas turbine nozzles prevented from being cracked as just described. Specifically, Japanese Unexamined Patent Application Publication No. 2007-154889 provides no description of a gas turbine nozzle in which stress related to thermal elongation caused by a rise in gas turbine nozzle temperature is reduced to reduce stress produced when thermal deformation occurs in the gas turbine nozzle.

SUMMARY OF THE INVENTION

Accordingly, the present invention provides a gas turbine nozzle in which stress caused by thermal elongation caused by a rise in gas turbine nozzle temperature is reduced to reduce stress produced when thermal deformation occurs in the gas turbine nozzle.

To achieve this, the present invention provides a gas turbine nozzle with nozzles formed integrally through an inner perimeter end wall and an outer perimeter end wall. The inner perimeter end wall has an upstream connection portion and a downstream connection portion. The upstream connection portion extends radially inward to be connected to an inner perimeter diaphragm. The downstream connection portion is located downstream from the upstream connection portion and extends radially inward to be connected to the inner perimeter diaphragm. The inner perimeter end wall has a thin-walled portion in a rear edge portion of the inner perimeter end wall, the thin-walled portion corresponding to a reduced wall thickness portion of the rear edge portion of the inner perimeter end wall.

According to the present invention, the gas turbine nozzle is capable of reducing stress related to thermal elongation caused by a rise in gas turbine nozzle temperature and thus reducing stress produced when thermal deformation occurs in the gas turbine nozzle.

These and other objects, features and advantages will be apparent from a reading of the following description of example embodiments.

DETAILED DESCRIPTION OF THE PREFERRED EMBODIMENTS

Examples according to the present invention will now be described. It is to be understood that like reference signs indicate substantially the same or similar configurations, which are not duplicated described and the description may be omitted.

EXAMPLES

Gas Turbine 100

Initially, a gas turbine 100 according to the example is described.

Figure 1:
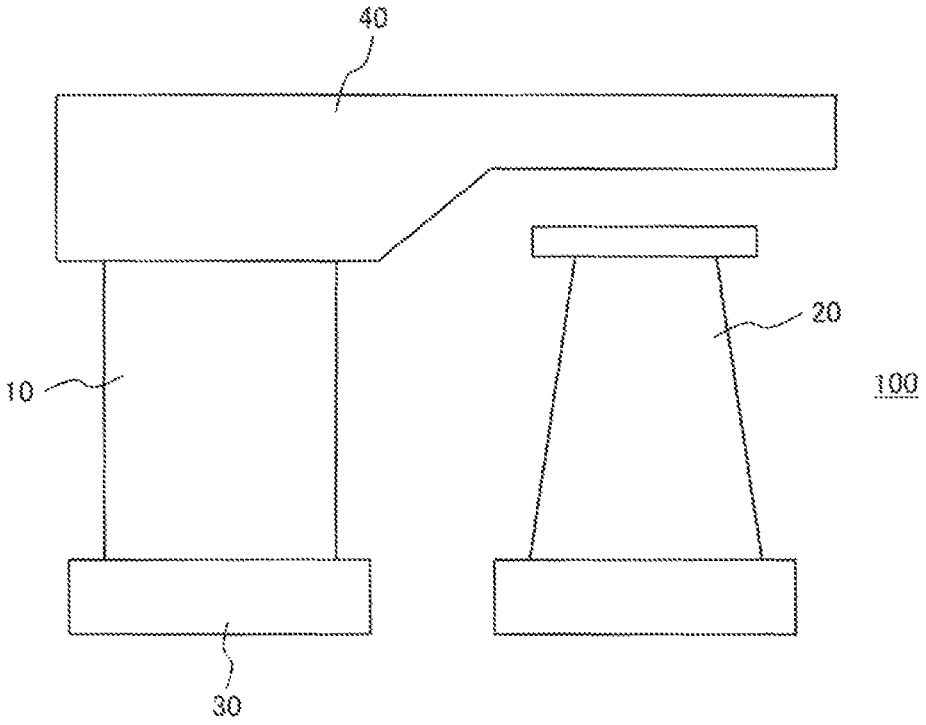
FIG. 1 is an explanatory schematic diagram illustrating a gas turbine 100 according to the example embodiments.

FIG. 1 is an explanatory schematic diagram illustrating the gas turbine 100 according to the example.

The gas turbine 100 has a gas turbine nozzle 10 and a gas turbine bucket 20, and introduces combustion gases.

The combustion gases are produced in a combustor (not shown) by igniting air compressed at a compressor (not shown), and fuel fed into the combustor.

In the gas turbine 100, the combustion gases produced in the combustor are introduced into the gas turbine nozzle 10, and then, after passing through the gas turbine nozzle 10, the combustion gases are is introduced into the gas turbine bucket 20.

The combustion gases thus introduced rotate the gas turbine bucket 20. In turn, the rotation of the gas turbine bucket 20 causes a generator (not shown) coaxially coupled to the gas turbine bucket 20 to generate electric power.

In this manner, the high temperature combustion gases produced in the combustor are introduced into the gas turbine nozzle 10.

And, from now on, in the gas turbine nozzle 10, as the temperature of the gas turbine nozzle 10 increasingly rises during operation of the gas turbine 100, the gas turbine nozzle 10 will be subjected to increased stress related to thermal elongation caused by the rise in temperature of the gas turbine nozzle 10. Then, the gas turbine nozzle 10 may possibly be subjected to increased stress produced when thermal deformation occurs in the gas turbine nozzle 10.

It is noted that the gas turbine nozzle 10 is connected on its inner perimeter side to an inner perimeter diaphragm 30, and on its outer perimeter side to an outer perimeter diaphragm 40.

Gas Turbine Nozzle 10

The gas turbine nozzle 10 according to the example will now be described.

Figure 2:
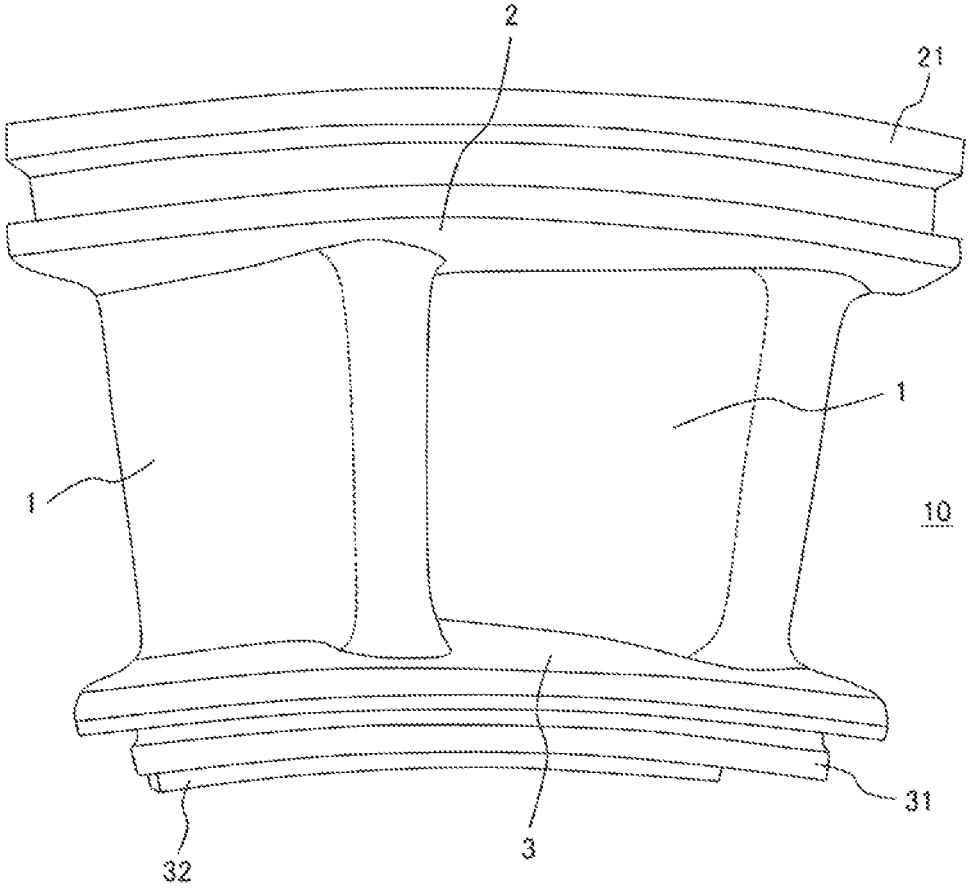
FIG. 2 is an explanatory perspective view illustrating a gas turbine nozzle 10 according to the example embodiments.

FIG. 2 is an explanatory perspective view illustrating the gas turbine nozzle 10 according to the example.

The gas turbine nozzle 10 according to the example is, in particular, a gas turbine nozzle 10 of coupled vane structure.

Specifically, in the gas turbine nozzle 10 of the coupled vane structure according to the example, two nozzles 1 are formed integrally through an inner perimeter end wall 3 and an outer perimeter end wall 2.

Also, two nozzles 1 formed in the gas turbine nozzle 10 are formed such that rear edge portions of the nozzles 1 are offset in the circumferential direction with respect to front edge portions of the nozzles 1. This allows the combustion gases flowing through the gas turbine nozzle 10 to be introduced into the gas turbine bucket 20 with efficiency.

Figure 3:
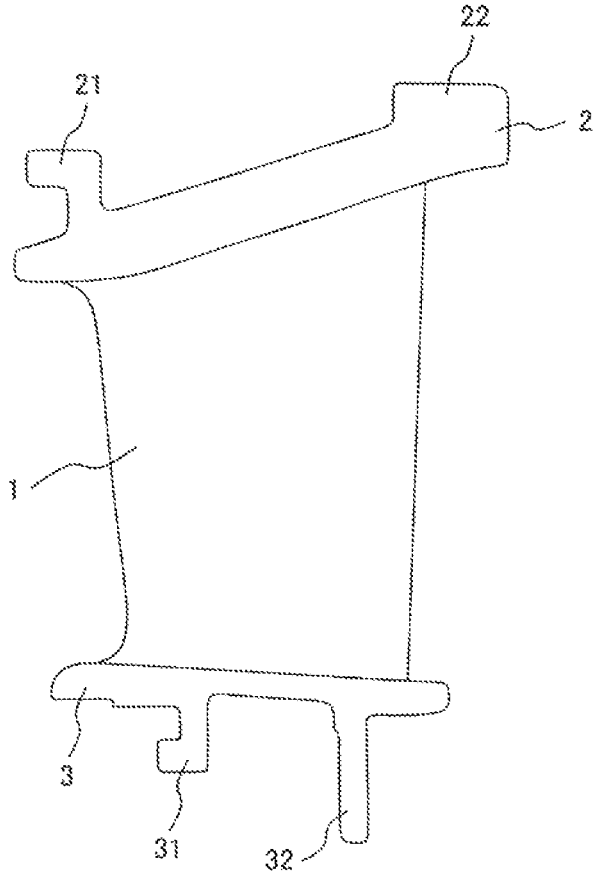
FIG. 3 is an explanatory sectional view illustrating the gas turbine nozzle 10 according to the example embodiments.

FIG. 3 is an explanatory sectional view illustrating the gas turbine nozzle 10 according to the example.

The gas turbine nozzle 10 has the nozzles 1, the outer perimeter end wall 2, and the inner perimeter end wall 3.

The outer perimeter end wall 2 has a front flange 21 and a rear flange 22. The front flange 21 extends radially outward and is connected to the outer perimeter diaphragm 40, while the rear flange 22 is connected to the outer perimeter diaphragm 40 and located downstream from the front flange 21, and extends radially outward.

The inner perimeter end wall 3 has an upstream connection portion 31 and a downstream connection portion 32. The upstream connection portion 31 extends radially inward and is connected to the inner perimeter diaphragm 30, while the downstream connection portion 32 is connected to the inner perimeter diaphragm 30 and located downstream from the upstream connection portion 31, and extends radially inward.

The nozzles 1 are formed between the outer perimeter end wall 2 and the inner perimeter end wall 3. A front edge portion of each nozzle 1 (an upstream portion in the introduction direction of combustion gases, i.e., the left end in FIG. 3) has a shorter vane length than the vane length of a rear edge portion thereof (a downstream portion in the introduction direction of combustion gases, i.e., the right end in FIG. 3). Because of this, in the nozzle 1, thermal elongation of the rear edge portion is greater than the thermal elongation of the front edge portion.

The thermal elongation of the rear edge portion of the nozzle 1 acts on a contact site between the nozzle 1 and the inner perimeter end wall 3. Specifically, the stress related to the thermal elongation (stress produced when thermal deformation occurs in the nozzle 1) increases in the contact site between the rear edge portion of the nozzle 1 and the inner perimeter end wall 3.

The stress related to the thermal elongation is produced in the rear edge portion of the inner perimeter end wall 3 (a portion downstream of the downstream connection portion 32). And, the stress produced in the rear edge portion of the inner perimeter end wall 3 can be reduced if the rigidity is reduced in the rear edge portion of the inner perimeter end wall 3.

Because the gas turbine nozzle 10 of the coupled vane structure has great rigidity provided in the rear edge portion of the inner perimeter end wall 3, great stress is produced in the rear edge portion of the inner perimeter end wall 3.

To address this, in the example, a thin-walled portion 33 is formed in the rear edge portion of the inner perimeter end wall 3 in order to reduce the stress produced in the rear edge portion of the inner perimeter end wall 3. In particular, in the example, the thin-walled portion 33 is formed in the rear edge portion of the inner perimeter end wall 3 of the gas turbine nozzle 10 of the coupled vane structure in which two nozzles 1 are integrally formed through the inner perimeter end wall 3 and the outer perimeter end wall 2.

Thin-Walled Portion 33

The thin-walled portion 33 according to the example will be described below.

Figure 4:
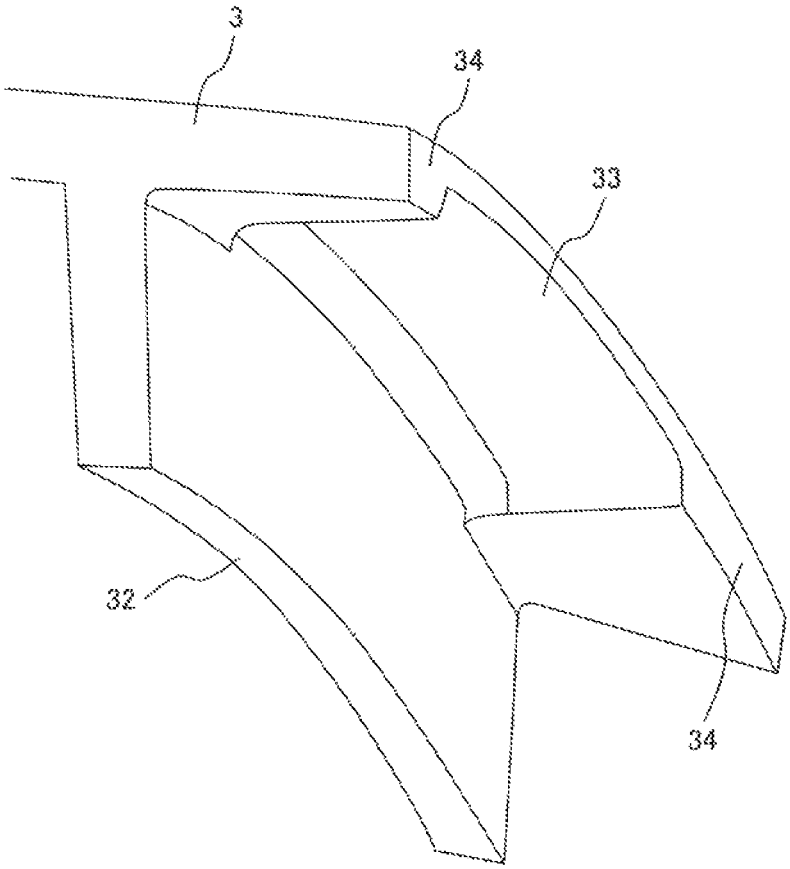
FIG. 4 is an explanatory perspective view illustrating a thin-walled portion 33 according to the example embodiments.

FIG. 4 is an explanatory perspective view illustrating the thin-walled portion 33 according to the example.

The thin-walled portion 33 is formed in the rear edge portion of the inner perimeter end wall 3. The thin-walled portion 33 corresponds to a portion of reduced wall thickness (radial thickness) of the rear edge portion of the inner perimeter end wall 3.

Forming the thin-walled portion 33 in the rear edge portion of the inner perimeter end wall 3 enables a reduction in rigidity in the rear edge portion of the inner perimeter end wall 3, which in turn enables a reduction in stress produced in the rear edge portion of the inner perimeter end wall 3.

It is noted that the thin-walled portion 33 may be formed by cutting the rear edge portion of the inner perimeter end wall 3 or may be casted together with inner perimeter end wall 3.

Further, the thin-walled portion 33 (a radial forming area for the thin-walled portion 33) is formed on the radial inside of the rear edge portion of the inner perimeter end wall 3.

By forming the thin-walled portion 33 on the radial inside of the rear edge portion of the inner perimeter end wall 3, the strength of the rear edge portion of the inner perimeter end wall 3 can be ensured while a reduction in stress produced in the rear edge portion of the inner perimeter end wall 3 can be achieved.

Specifically, on the rear edge portion of the inner perimeter end wall 3, the thin-walled portion 33 and an empty space portion are formed. The empty space portion is formed by, for example, cutting the rear edge portion of the inner perimeter end wall 3 from the inner perimeter in the radial direction.

Also, a radial thickness of the empty space portion is preferably greater than the radial thickness of the rear edge portion of the inner perimeter end wall 3 in which the thin-walled portion 3 is formed (the radial thickness of the thin-walled portion 33). Stated another way, a radial thickness of the thin-walled portion 33 is preferably smaller than the radial thickness of the empty space portion. In most cases, the radial thickness of the rear edge portion of the inner perimeter end wall 3 ranges from 9 mm to 10 mm, and the radial thickness of the empty space portion ranges from 5 mm to 6 mm. That is, in this case, the thickness of the thin-walled portion 33 is on the order of 3 to 4 mm.

This may provide a balance between ensuring the strength of the rear edge portion of the inner perimeter end wall 3 and reducing the stress produced in the rear edge portion of the inner perimeter end wall 3.

Further, the empty space portion is preferably formed in an area from the contact site between the downstream connection portion 32 and the inner perimeter end wall 3 to the rearmost edge of the inner perimeter end wall 3 in the axial direction. Stated another way, the thin-walled portion 33 (the axial forming area for the thin-walled portion 33) is preferably formed in an area from the contact site between the downstream connection portion 32 and the inner perimeter end wall 3 to the rearmost edge of the inner perimeter end wall 3 in the axial direction.

By virtue of this, the stress produced in the rear edge portion of the inner perimeter end wall 3 can be effectively reduced.

Also, the empty space portion is preferably formed in a central portion of the rear edge portion of the inner perimeter end wall 3 in the circumferential direction. Specifically, the thin-walled portion 33 (the radial forming area for the thin-walled portion 33) is preferably formed in the central portion of the rear edge portion of the inner perimeter end wall 3 in the circumferential direction, and thick-walled portions 34 (e.g., non-cut areas) are preferably formed on both sides of the thin-walled portion 33. In this manner, it is preferable that, when the rear edge portion of the inner perimeter end wall 3 is viewed from the axial direction, the thick-walled portions 34 are formed on both sides of the thin-walled portion 33. Also, the thick-walled portions 34 on both the sides are preferably equal in length in the circumferential direction.

By virtue of this, it is possible to ensure the strength of the rear edge portion of the inner perimeter end wall 3 as well as to reduce the stress produced in the rear edge portion of the inner perimeter end wall 3.

Also, in the gas turbine nozzle 10 according to the example, the rear edge portions of two nozzles 1 are offset in the circumferential direction with respect to the axis. Stated another way, the rear edge portions of two nozzles 1 are formed to be inclined in the circumferential direction with respect to the rear edge portion of the inner perimeter end wall 3.

Therefore, the rear edge portion of one nozzle 1 is located in the rear edge portion of the inner perimeter end wall 3 in which the thin-walled portion 33 is formed, while the rear edge portion of the other nozzle 1 is located in the rear edge portion of the inner perimeter end wall 3 in which the thick-walled portion 34 is formed.

By virtue of this, it is possible to ensure the strength of the rear edge portion of the inner perimeter end wall 3 as well as to reduce the stress produced in the rear edge portion of the inner perimeter end wall 3.

In this manner, in the gas turbine nozzle 10 according to the example, two nozzles 1 are formed integrally through the inner perimeter end wall 3 and the outer perimeter end wall 2. The inner perimeter end wall 3 has: the upstream connection portion 31 that extends radially inward to be connected to the inner perimeter diaphragm 30; and the downstream connection portion 32 that is located downstream from the upstream connection portion 31 and extends radially inward to be connected to the inner perimeter diaphragm 30. The inner perimeter end wall 3 has the thin-walled portion 33 in the rear edge portion thereof, the thin-walled portion 33 corresponding to a reduced wall thickness portion of the rear edge portion of the inner perimeter end wall 3.

According to the example, it is possible to reduce the stress related to thermal elongation caused by a rise in temperature of the gas turbine nozzle 10, and thus to reduce the stress produced by thermal deformation of the gas turbine nozzle 10.

It should be understood that the present invention is not limited to the above examples and is intended to embrace various modifications. The above examples have been described in detail for the purpose of explaining the present invention clearly, and the present invention is not necessarily limited to including all the components and configurations described above.

REFERENCE SIGNS LIST

1 . . . Nozzle
2 . . . Outer perimeter end wall
3 . . . Inner perimeter end wall
10 . . . Gas turbine nozzle
20 . . . Gas turbine bucket
21 . . . Front flange
22 . . . Rear flange
30 . . . Inner perimeter diaphragm
31 . . . Upstream connection portion
32 . . . Downstream connection portion
33 . . . Thin-walled portion
34 . . . Thick-walled portion
40 . . . Outer perimeter diaphragm
100 . . . Gas turbine

What is claimed is:

1. A gas turbine nozzle comprising:

nozzles formed integrally through an inner perimeter end wall and an outer perimeter end wall, wherein the inner perimeter end wall has an upstream connection portion and a downstream connection portion, the upstream connection portion extending radially inward to an inner perimeter diaphragm, the downstream connection portion being located downstream from the upstream connection portion and extending radially inward to the inner perimeter diaphragm, and the inner perimeter end wall has a thin-walled portion in a rear edge portion of the inner perimeter end wall, the thin-walled portion corresponding to a reduced wall thickness portion of the rear edge portion of the inner perimeter end wall, wherein the gas turbine nozzle has a coupled vane structure in which two of the nozzles are formed integrally through the inner perimeter end wall and the outer perimeter end wall, and the thin-walled portion is formed on a radial inside of the rear edge portion of the inner perimeter end wall.

2. The gas turbine nozzle according to claim 1, wherein the thin-walled portion has a radial thickness smaller than a radial thickness of thick wall portions located on both axial ends of the thin-walled portion.

3. A gas turbine nozzle comprising:

nozzles formed integrally through an inner perimeter end wall and an outer perimeter end wall, wherein the inner perimeter end wall has an upstream connection portion and a downstream connection portion, the upstream connection portion extending radially inward to an inner perimeter diaphragm, the downstream connection portion being located downstream from the upstream connection portion and extending radially inward to the inner perimeter diaphragm, and the inner perimeter end wall has a thin-walled portion in a rear edge portion of the inner perimeter end wall, the thin-walled portion corresponding to a reduced wall thickness portion of the rear edge portion of the inner perimeter end wall, the gas turbine nozzle has a coupled vane structure in which two of the nozzles are formed integrally through the inner perimeter end wall and the outer perimeter end wall, and the thin-walled portion is formed in an area between the inner perimeter end wall and the downstream connection portion.

4. A gas turbine nozzle comprising:

nozzles formed integrally through an inner perimeter end wall and an outer perimeter end wall, wherein the inner perimeter end wall has an upstream connection portion and a downstream connection portion, the upstream connection portion extending radially inward to an inner perimeter diaphragm, the downstream connection portion being located downstream from the upstream connection portion and extending radially inward to the inner perimeter diaphragm, and the inner perimeter end wall has a thin-walled portion in a rear edge portion of the inner perimeter end wall, the thin-walled portion corresponding to a reduced wall thickness portion of the rear edge portion of the inner perimeter end wall, wherein the gas turbine nozzle has a coupled vane structure in which two of the nozzles are formed integrally through the inner perimeter end wall and the outer perimeter end wall, and the thin-walled portion is formed in a central portion of the rear edge portion of the inner perimeter end wall in a circumferential direction.

* * * * *